US010107004B1

(12) United States Patent
Mercer

(10) Patent No.: US 10,107,004 B1
(45) Date of Patent: Oct. 23, 2018

(54) SINGLE DOOR MULTI-NICHE DUAL LOCKING MODULAR COLUMBARIUM ASSEMBLY

(71) Applicant: William Edgar Mercer, Houston, TX (US)

(72) Inventor: William Edgar Mercer, Houston, TX (US)

( * ) Notice: Subject to any disclaimer, the term of this patent is extended or adjusted under 35 U.S.C. 154(b) by 0 days.

(21) Appl. No.: 15/923,665

(22) Filed: Mar. 16, 2018

Related U.S. Application Data

(60) Provisional application No. 62/481,666, filed on Apr. 4, 2017.

(51) Int. Cl.

| | |
|---|---|
| ***E04H 13/00*** | (2006.01) |
| ***E05B 65/00*** | (2006.01) |
| ***E05B 63/00*** | (2006.01) |
| ***E05B 17/22*** | (2006.01) |

(52) U.S. Cl.
CPC ..... *E04H 13/006* (2013.01); *E05B 17/22* (2013.01); *E05B 63/00* (2013.01); *E05B 65/0057* (2013.01)

(58) Field of Classification Search
CPC ..... E04H 13/00; E04H 13/006; E04H 13/008; B65F 1/004; B65F 1/0053; A61G 17/08; E05B 17/22; E05B 63/00; E05B 65/0057
USPC ..... 27/1, 35; 52/134, 136; 220/507, 523
See application file for complete search history.

(56) References Cited

U.S. PATENT DOCUMENTS

| | | | | |
|---|---|---|---|---|
| 4,614,066 A * | 9/1986 | Koppenberg | ..... | E04H 13/006 312/111 |
| 5,477,594 A * | 12/1995 | LePage | ..... | E04H 13/006 211/194 |
| 6,250,025 B1 * | 6/2001 | Darby | ..... | E04H 13/006 52/137 |
| 9,051,752 B1 * | 6/2015 | Muthusami | ..... | E04H 13/008 |

(Continued)

FOREIGN PATENT DOCUMENTS

| | | | | |
|---|---|---|---|---|
| CA | 2421667 A1 * | 1/2004 | ..... | E04H 13/006 |
| ES | 1133830 U * | 11/2014 | ..... | E04H 13/006 |

(Continued)

*Primary Examiner* — William L Miller
(74) *Attorney, Agent, or Firm* — Buskop Law Group, P.C.; Wendy Buskop

(57) ABSTRACT

A single door multi-niche dual locking modular columbarium assembly for containing cremated remains has a first single door multi-niche dual locking modular columbariums, a second single door multi-niche dual locking modular columbariums, and a plurality of spacers. The first single door multi-niche dual locking modular columbariums and additional single door multi-niche dual locking modular columbariums have a plurality of solid vertical walls, a plurality of aligned horizontal bases, a top plate, a bottom plate, a first side, a second side, a unitary door, a hinge, and a dual non-identical key locking mechanism. The single door multi-niche dual locking modular columbarium assembly is configurable, expandable, and alignable using the plurality of modules. The single door multi-niche dual locking modular columbarium is configured to receive simultaneously multiple cremation containers into the dual niches via each unitary door, the single door multi-niche dual locking modular columbarium assembly forming a small footprint modular columbarium.

15 Claims, 9 Drawing Sheets

(56) References Cited

U.S. PATENT DOCUMENTS

| | | | | |
|---|---|---|---|---|
| 2004/0177570 | A1* | 9/2004 | Stienwand | E04H 13/006 52/133 |
| 2009/0282752 | A1* | 11/2009 | Stilnovich | E04H 13/006 52/133 |

FOREIGN PATENT DOCUMENTS

| | | | | |
|---|---|---|---|---|
| ES | 1198359 | U * | 11/2017 | |
| WO | WO-2009120161 | A1 * | 10/2009 | G06Q 20/32 |

* cited by examiner

ALL DOUBLE DEPTH NICHE

ALL SINGLE DEPTH NICHES

SINGLE DOOR MULTI-NICHE DUAL LOCKING MODULAR COLUMBARIUM ASSEMBLY

CROSS REFERENCE TO RELATED APPLICATIONS

The present application claims priority to and the benefit of U.S. Provisional Patent Application Ser. No. 62/481,666 filed on Apr. 3, 2017, entitled "SINGLE DOOR MULTI-NICHE MODULAR COLUMBARIUM ASSEMBLY." This reference is hereby incorporated in its entirety.

FIELD

The present embodiment generally relates to a single door multi-niche dual locking modular columbarium assembly for containing cremated remains.

BACKGROUND

A need exists for a cost efficient design for a columbarium assembly that is expandable by modular additions.

A further need exists for a columbarium that enables many cremated remains to be placed in one location and comply with state and municipal registry requirements.

The present embodiments meet these needs.

BRIEF DESCRIPTION OF THE DRAWINGS

The detailed description will be better understood in conjunction with the accompanying drawings as follows.

Figure 1:
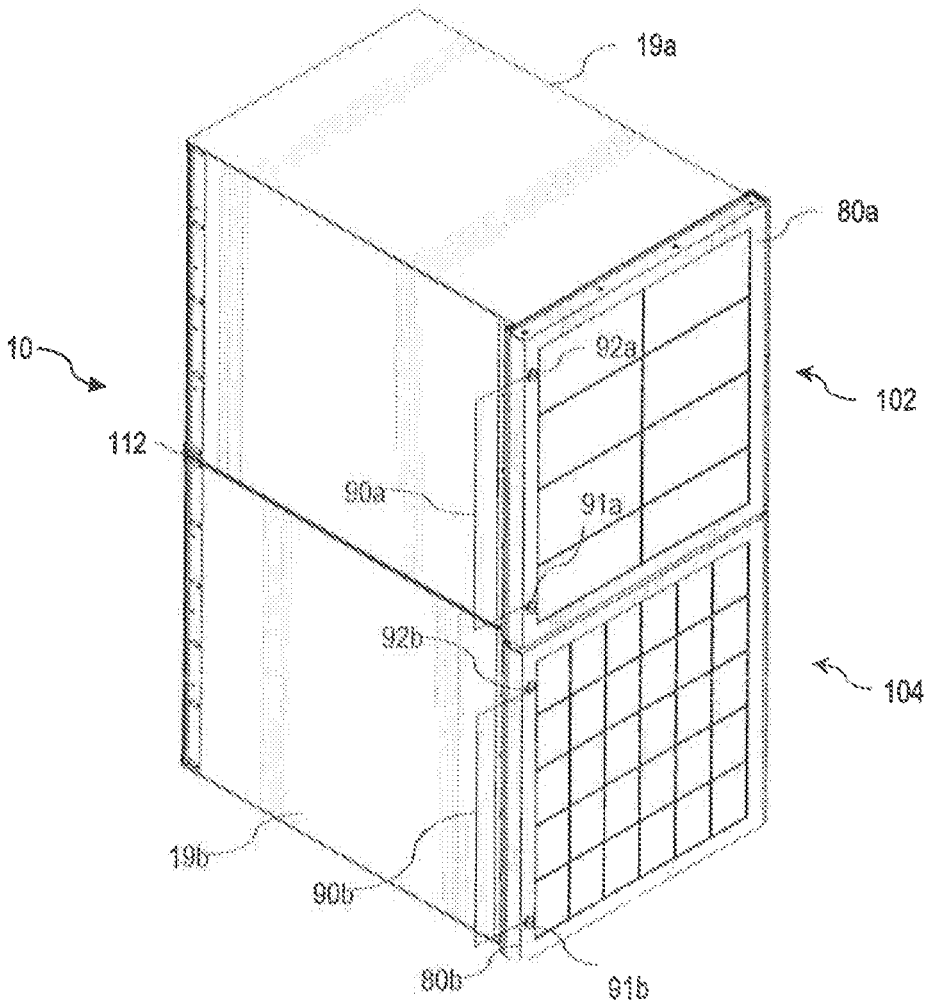
FIG. 1 depicts a closed view of a single door multi-niche dual locking modular columbarium assembly according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present invention relates to a single door multi-niche dual locking modular columbarium assembly for containing cremated remains.

The single door multi-niche dual locking modular columbarium assembly for containing cremated remains has a plurality of first modular columbariums and a plurality of second modular columbariums.

Each module contains a plurality of solid vertical walls, a plurality of aligned horizontal bases connected between pairs of solid vertical walls defining a plurality of identical sized double niches, a top plate connected over the plurality of solid vertical walls, a bottom plate connected over the plurality of vertical walls at an end opposite a top plate, a first side connected over a first end of the aligned horizontal bases, a second side connected over a second end of the aligned horizontal bases opposite the first end of the aligned horizontal bases, a unitary door with a single integral door frame covering all the double niches and a unitary door insert installed in the single integral door frame, a hinge engaging the single integral door frame to the first side, a dual non-identical key locking mechanism requiring a first key profile different from a second key profile to unlock the dual non-identical key locking mechanism, and a plurality of spacers with a plurality of fasteners.

Each spacer separates while connecting one of the modules to an adjacent module in at least one of: a vertical alignment, a horizontal alignment, and an offset alignment.

The single door multi-niche dual locking modular columbarium assembly is configurable, expandable, and alignable using the plurality of modules.

In embodiments, the single door multi-niche dual locking modular columbarium assembly is configured to receive multiple cremation containers into the dual niches via each unitary door.

The single door multi-niche dual locking modular columbarium assembly forms a small footprint single door multi-niche dual locking modular columbarium.

The embodiments allow cremated remains to be located in one place cost effectively.

The embodiments enable sanitary containment of cremated remains.

The single door multi-niche dual locking modular columbarium assembly is relatively lightweight and easily assembled and portable, which results in inexpensive shipping charges.

The embodiments are cost efficient. A cemetery does not need to overbuy a unit. The cemetery can buy two modules or six modules. Afterwards, the cemetery can purchase two additional modules based upon the demand of its clients.

The following definitions are used herein:

The term "assembly" refers to modular columbariums, which are assembled by housing fasteners together.

The term "double depth niche" can refer to a niche in a columbarium that holds two urns.

The term "cremated remains" refer to the remains after a body has been exposed to extreme heat, flame and processing in order to reduce the body to ashes and small bone. Cremated remains can be human remains or the remains of pets selected by a next of kin or owner.

The term "housing fastener" can refer to plates with clamps, adhesive, and nuts and bolts.

The term "multi-niche" refers to a plurality of individual space niches within a columbarium or a plurality of double individual space niches within a columbarium.

The term "modular columbarium" refers to an individual columbarium capable of being connected to another individual columbarium, wherein each individual columbarium has many niches with a single door. As an example, a first modular columbarium can be connected to a second modular columbarium in a stacked arrangement forming a "multi-niche modular columbarium" assembly which can be a vertical stack. Specifically, a first modular columbarium can be positioned on top of a second modular columbarium forming a "multi-niche modular columbarium" assembly. As another example, a first modular columbarium can be connected to a second modular columbarium in a horizontal arrangement. The horizontal arrangement can have all the modular columbarium connected in a single plane in a single level arrangement. In the horizontal arrangement, the first modular columbarium is positioned adjacent and connected to the second modular columbarium in the same plane forming the "multi-niche modular columbarium" assembly.

The term "dual non-identical key locking mechanism" can refer to a locking mechanism on a modular columbarium unitary door, wherein the first lock is different and requires a separate key from the second lock.

The term "single depth niche" can refer to a niche in a columbarium that holds one urn.

Now turning to the figures, FIG. 1 depicts the a single door multi-niche dual locking modular columbarium assembly 10 for containing cremated remains configured to prevent unauthorized comingling or unauthorized disposition of cremated remains.

The single door multi-niche dual locking modular columbarium assembly 10 can have a first single door multi-niche dual locking modular columbarium 102.

The first single door multi-niche dual locking modular columbarium 102 can include a first modular columbarium housing 19*a* containing a plurality of niches 40*a*-40*h*, each niche being a single depth niche or a double depth niche.

The first modular columbarium unitary door 80*a* can have a first dual non-identical key locking mechanism 90*a* forming a secure locking connection between the first modular columbarium unitary door 80*a* and the first modular columbarium housing 19*a*.

The first dual non-identical key locking mechanism can require a first key profile 91*a* different from a second key profile 92*a* to unlock the second dual non-identical key locking mechanism.

A first modular columbarium unitary door 80*a* can be connected to the first modular columbarium housing covering all niches 40 in the first multi-niche dual locking modular columbarium.

The single door multi-niche dual locking modular columbarium assembly 10 can have second single door multi-niche dual locking modular columbarium 104.

The second single door multi-niche dual locking modular columbarium 104 can include a second modular columbarium housing 19*b* containing a plurality of niches. Each niche can be a single depth niche or a double depth niche.

A second modular columbarium unitary door 80*b* can be connected to the second modular columbarium housing covering all niches in the second single door multi-niche dual locking modular columbarium.

The second modular columbarium unitary door 80*b* can have a second dual non-identical key locking mechanism 90*b* forming a secure locking connection between the second modular columbarium unitary door and the second modular columbarium housing 19*b*.

The second dual non-identical key locking mechanism 90*b* can require a third key profile 91*b* different from a fourth key profile 92*b* to unlock the second dual non-identical key locking mechanism.

In embodiments, the single door multi-niche modular dual locking columbarium assembly 10 can have a plurality of housing fasteners 112 to hold the first single door multi-niche dual locking modular columbarium to the second single door multi-niche dual locking modular columbarium modular.

Each housing fastener can separate and connect one of the single door multi-niche dual locking modular columbariums to an adjacent single door multi-niche dual locking modular columbarium in at least one of: a vertical alignment, a horizontal alignment, an offset alignment or combinations thereof.

In embodiments, the single door multi-niche modular dual locking columbarium assembly can contain cremated remains and can be configured to prevent unauthorized comingling or unauthorized disposition of cremated remains in a user specified configuration using the plurality of dual locking modular columbarium.

Each single door multi-niche modular dual locking columbarium can be configured to receive multiple cremation containers into the niches via each modular columbarium unitary door. The multi-niche modular dual locking columbarium assembly can be recordable with state or local government authorities when state and local laws require recordation.

Figure 2:
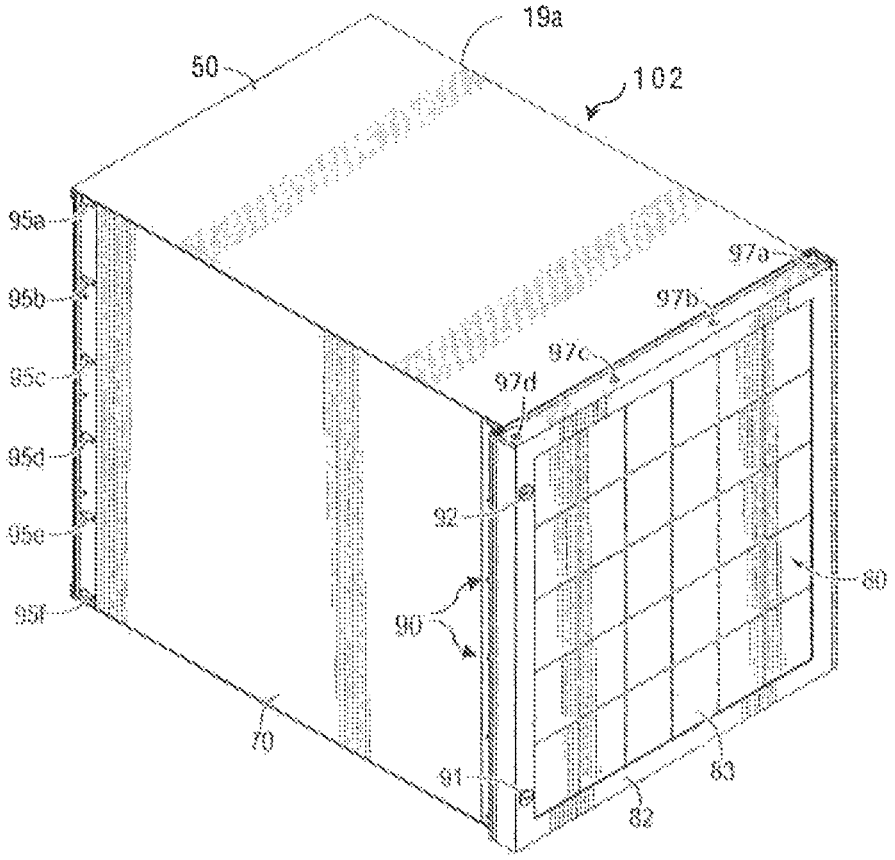
FIG. 2 depicts a closed view of a single door multi-niche dual locking modular columbarium according to one or more embodiments.
Figure 3:
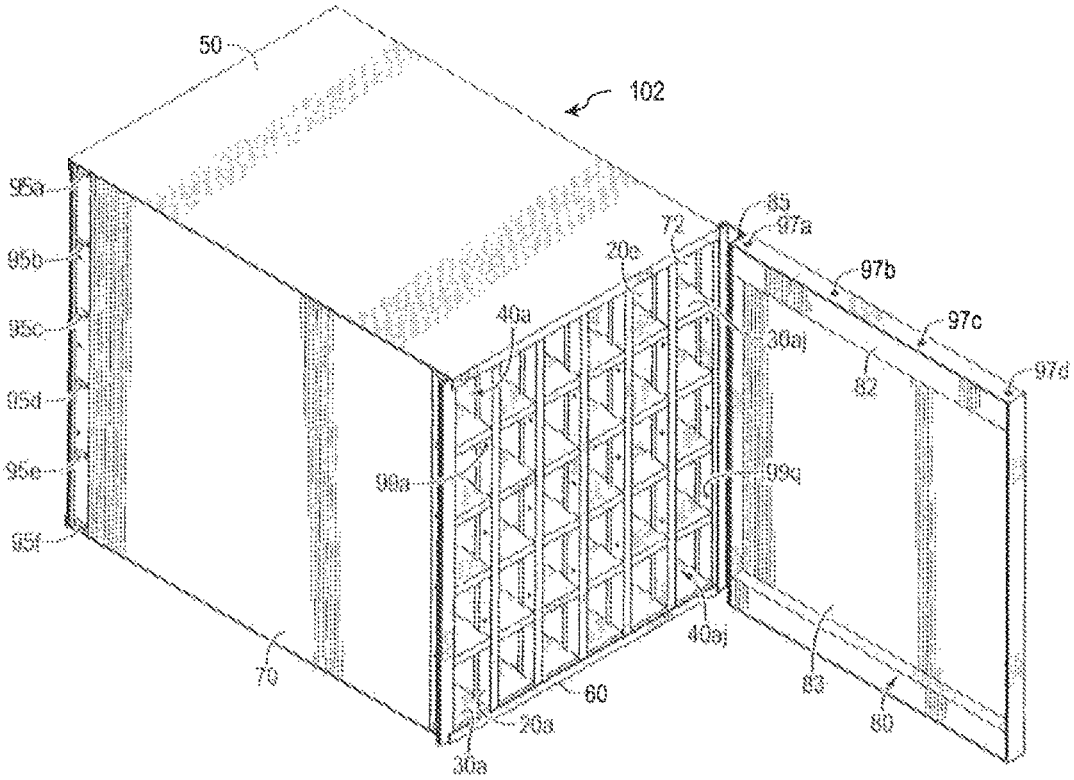
FIG. 3 depicts an open view of a single door multi-niche dual locking modular columbarium according to one or more embodiments.
Figure 4:
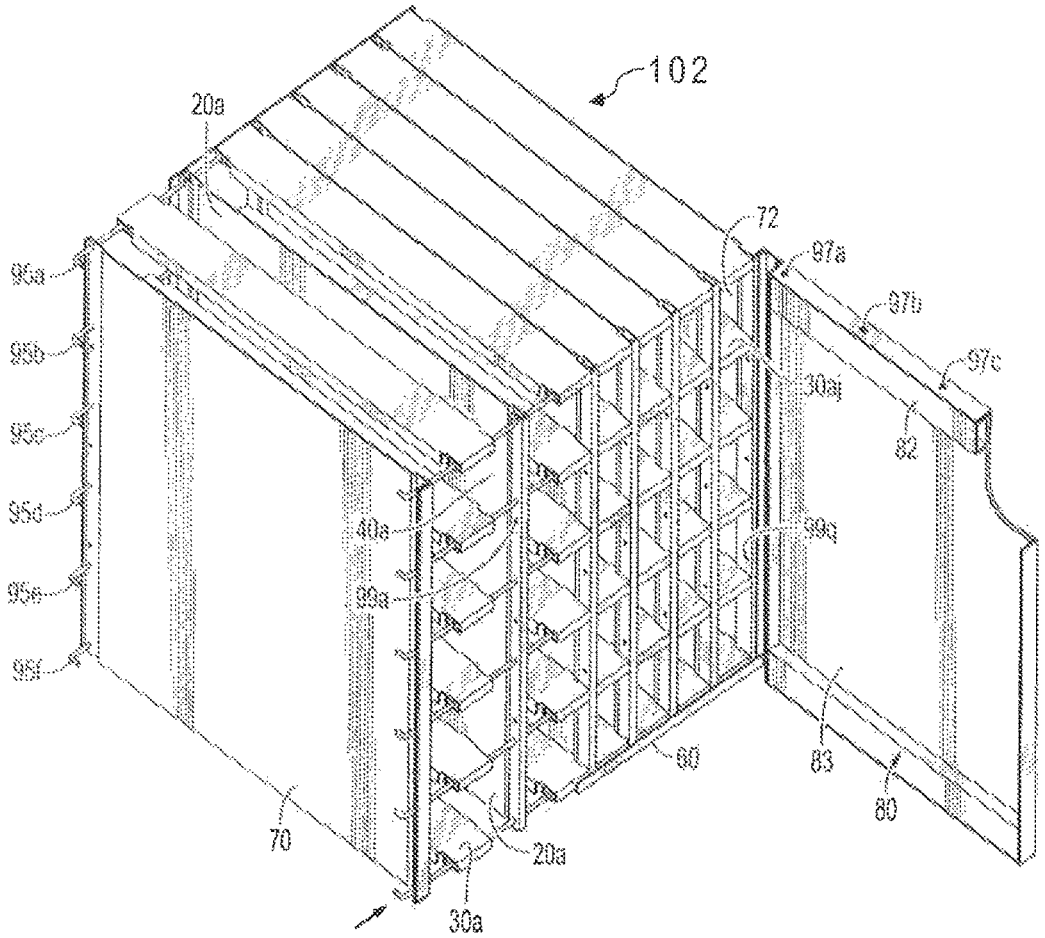
FIG. 4 depicts a partially exploded open view of a single door multi-niche dual locking modular columbarium according to one or more embodiments.

FIG. 2 through FIG. 4 depict the single door multi-niche dual locking modular columbarium 102 according to one or more embodiments.

In embodiments, each single door multi-niche modular dual locking columbarium can have a modular columbarium unitary door 80.

In embodiments, the modular columbarium unitary door 80 can have a single integral door frame 82 which will surround each modular columbarium housing.

Each unitary door 80 covering all of the plurality of niches 40*a*-40*aj* shown in FIGS. 3 and 4. The plurality of niches are single depth niche or double depth niches.

A unitary door insert 83 can be installed in the single integral door frame via fasteners 97*a*-97*d*. In other embodiments, the fasteners can be a weld. A hinge 85 shown in FIG. 3, can engage the single integral door frame 82 on a first side 72 of each modular columbarium housing.

Each modular columbarium housing 19*a* can include a plurality of solid vertical walls 20*a*-20*e*.

In embodiments, a plurality of aligned horizontal bases 30*a*-30*aj* can be in the modular columbarium housing connected between pairs of solid vertical walls 20*a*-20*e* defining a plurality of identical depth niches 40*a*-40*aj*.

In embodiments, the modular columbarium housing has a top 50 that connects over the plurality of solid vertical walls 20*a*-20*e*.

In embodiments, the modular columbarium housing has a bottom 60 that connects the plurality of vertical walls 20*a*-20*e* at an end opposite the top 50.

A second side 70 can connect edges of a first group of aligned horizontal bases 30*a*-30*aj*.

The first side 72 of the modular columbarium housing can connect a second end of the same first group of aligned horizontal bases or a second group of aligned horizontal bases 30*a*-30*aj* opposite the first end of the aligned horizontal bases 30*a*-30*aj*.

That is, in an embodiment, a plurality of bases can be installed wall to wall and wall pieces can be installed between the bases. In another embodiment a plurality of walls are installed top to bottom and base pieces are installed between the walls.

In embodiments, rods 95*a*-95*f* can extend from the first side 72 to the second side 70 through holes 99*a*-99*q* for adjusting and supporting the aligned horizontal bases 30*a*-30*aj*.

In embodiments, a first dual non-identical key locking mechanism can form a secure locking connection between the first modular columbarium unitary door and the first modular columbarium housing. The first dual non-identical key locking mechanism requires a first key profile different from a second key profile to unlock the first dual non-identical key locking mechanism.

In embodiments, each of the solid vertical walls and aligned horizontal bases can each be made from steel.

In embodiments, the single integral door frame can be made from steel.

The door insert can be a plate or extruded aluminum capable of holding the names of the departed.

Figure 5:
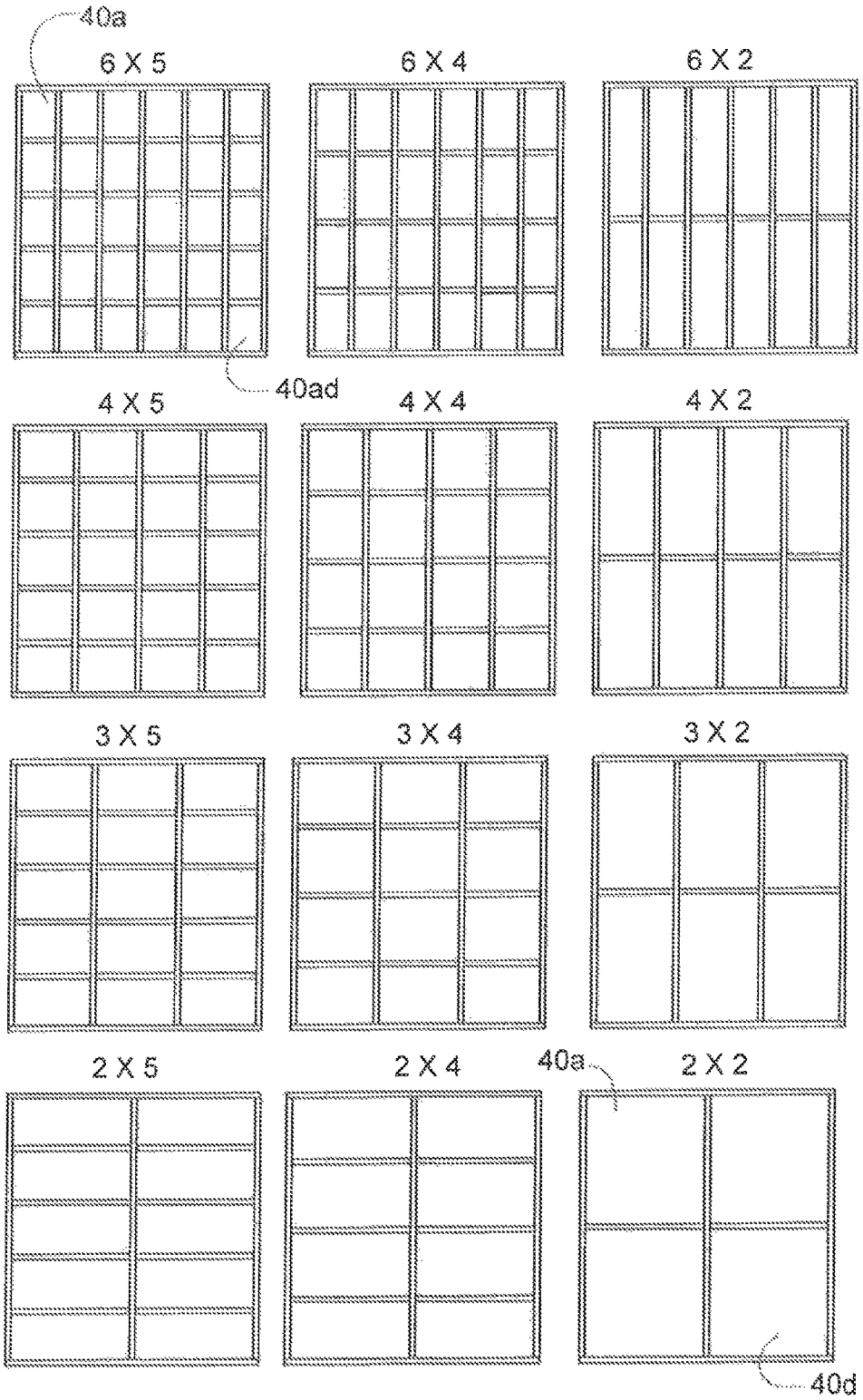
FIG. 5 depicts various arrangements of the double niches containable within a single door multi-niche dual locking modular columbarium assembly according to one or more embodiments.

FIG. 5 depicts various arrangements of the quantity of plurality of niches 40*a*-40*ad* that can be installed in one of the modular columbarium housing according to one or more embodiments.

The single door multi-niche modular dual locking columbarium assembly can have double niches or single niches with these various quantity arrangements. The arrangements of double niches can be from 4.5 inches high×3.0 inches wide to much larger, which provide enough space for from eight to sixty containers of cremated remains in a modular columbarium housing.

An exemplary modular columbarium housing could have 30 double niches.

Other exemplary modular columbarium housings can have 24 double or single niches.

The double niches can be sized a variety of sizes, such as 6 inches high×10 inches wide and 28 inches deep.

Examples of single depth niches can be a variety of sizes, such as 6 inches high×10 inches wide and 14 inches deep.

Figure 6:
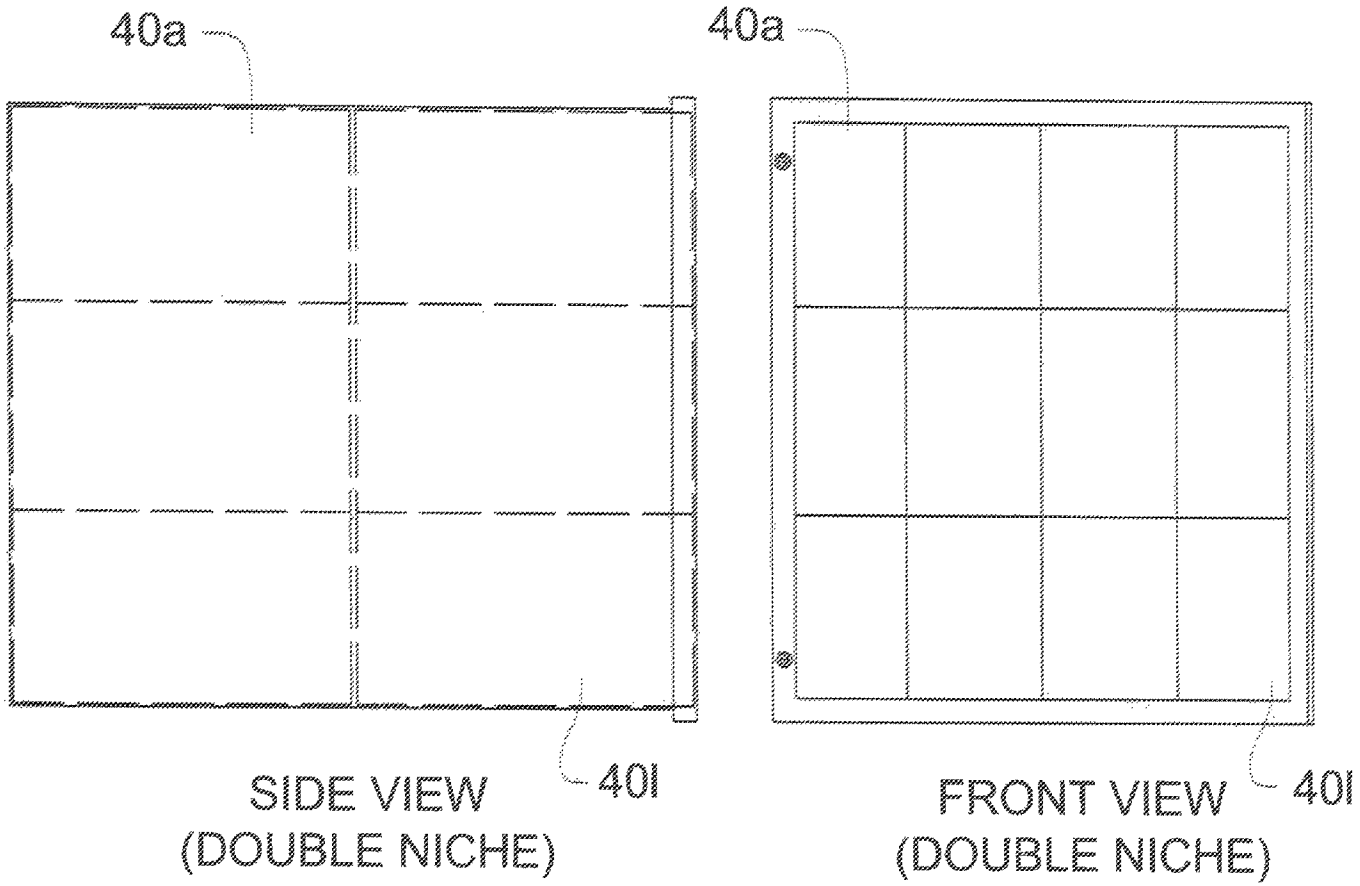
FIG. 6 depicts a side view and a front view of a double niche embodiment of a single door multi-niche dual locking modular columbarium.

FIG. 6 depicts a side view of a plurality of double niches 40*a*-40*l* and a front view of a plurality of the same double niches 40*a*-40*l*.

Figure 7A:
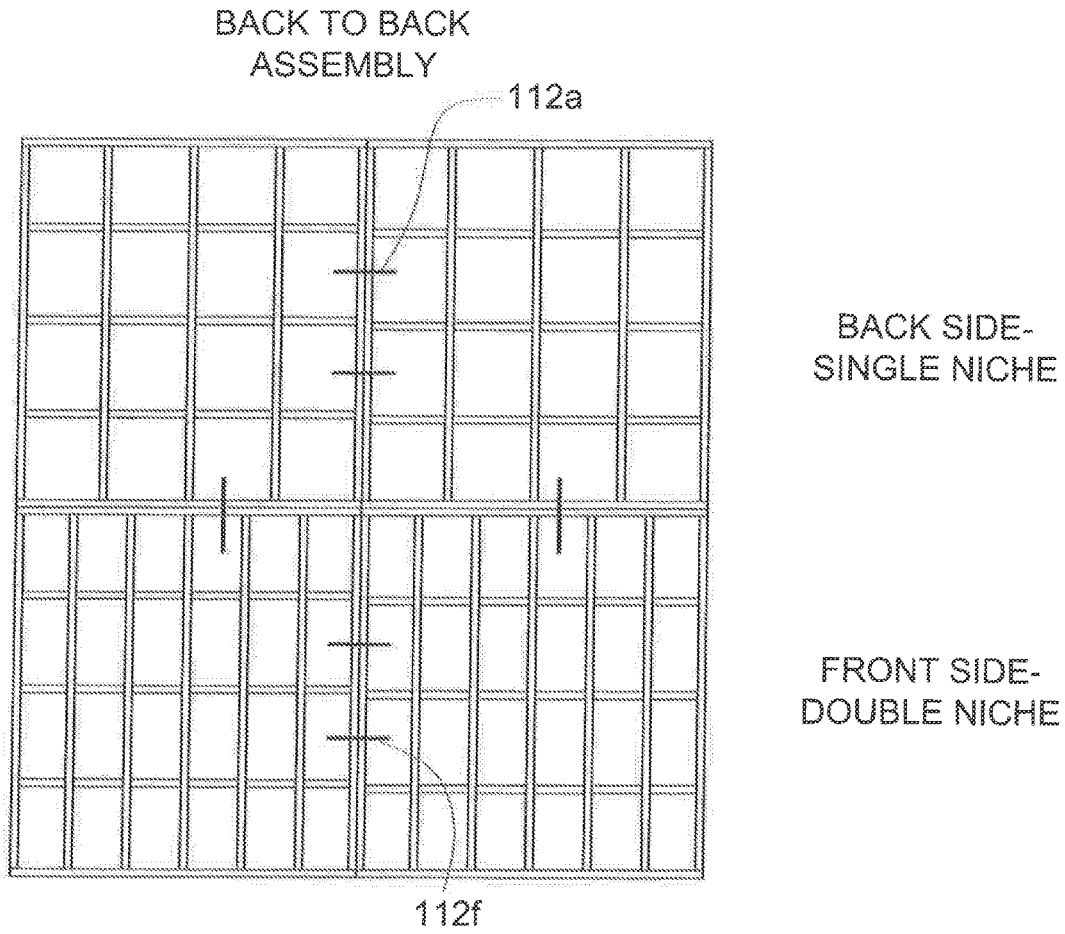
FIG. 7A depicts the front and back sides a single depth niche and a double niche according to one or more embodiments.
Figure 7B:
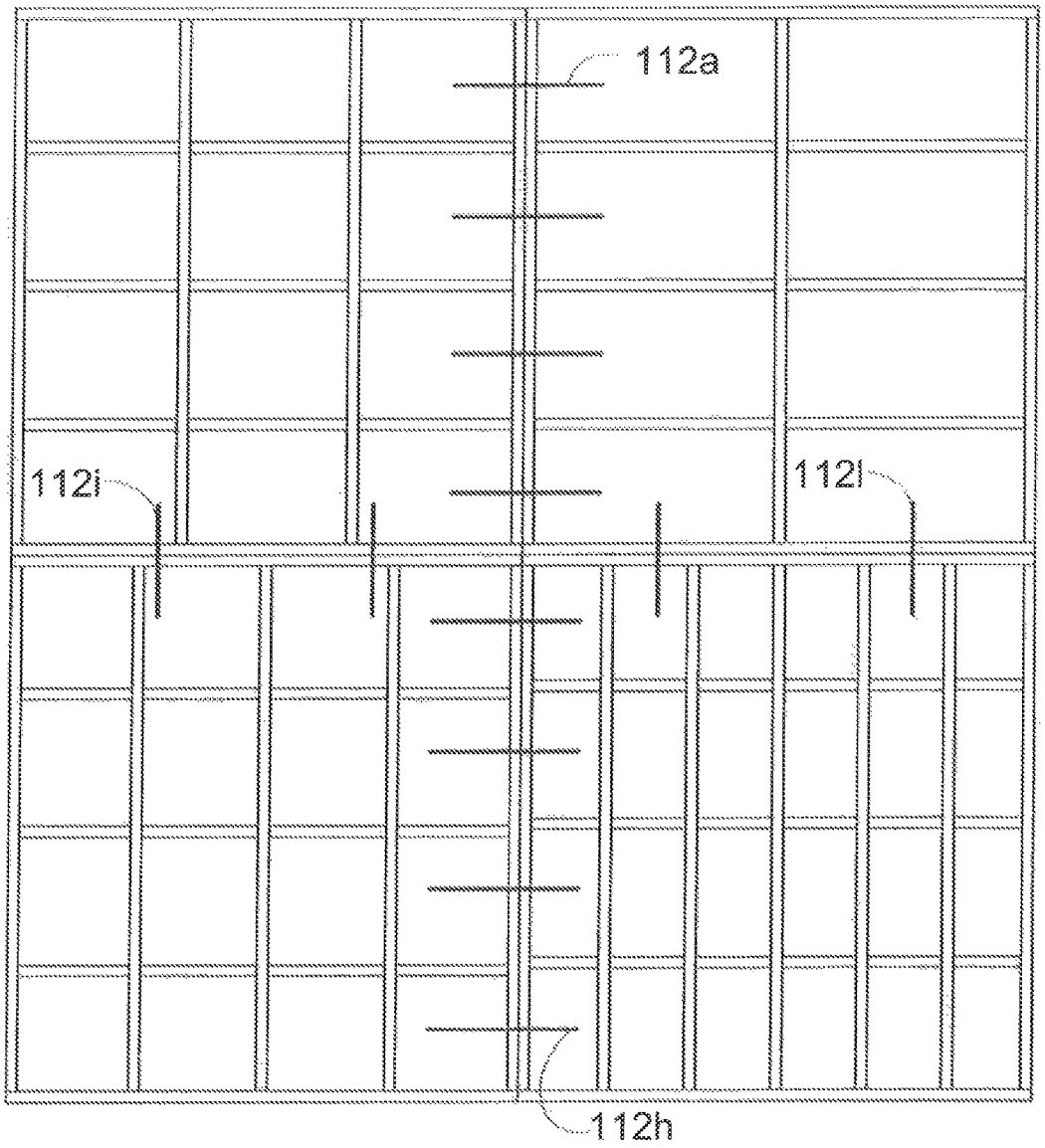
FIG. 7B depicts an exemplary four module assembly with double depth niches according to one or more embodiments.
Figure 7C:
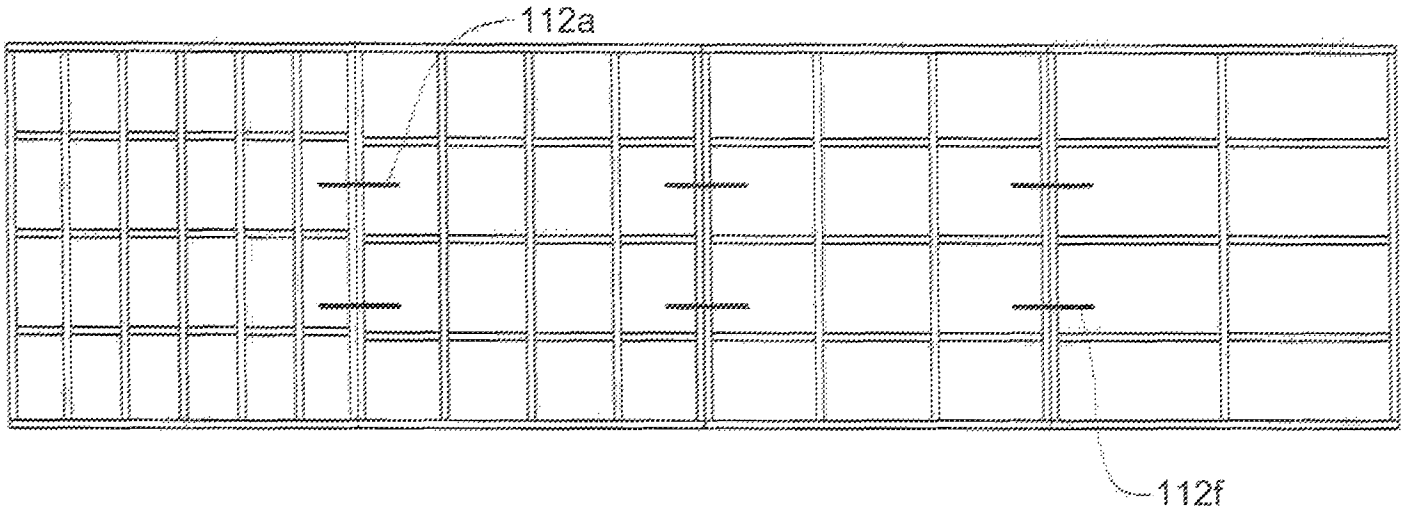
FIG. 7C depicts an exemplary four module assembly with single depth niches according to one or more embodiments.

FIGS. 7A-7C show one or more embodiments of double niches.

FIG. 7A depicts a back to back assembly of the single door multi-niche dual locking modular columbarium assembly with a front side of a plurality of double niches and a back side of a plurality of single depth niches.

Sixteen (16) single depth niches are shown for each single door multi-niche dual locking modular columbarium on the back side of the assembly.

Twenty four (24) double depth niches having 48 places for cremated remains are shown for each multi-niche dual locking modular columbarium on the front side of the assembly. The four single door multi-niche dual locking modular columbariums are connected by clamps as the housing fasteners.

FIG. 7B depicts an exemplary single door multi-niche dual locking modular columbarium assembly with four single door multi-niche dual locking modular columbariums each multi-niche dual locking modular columbariums having double depth niches.

The FIG. 7B assembly is shown with a second horizontal arrangement fastened over a first horizontal arrangement.

The first horizontal arrangement has two single door multi-niche dual locking modular columbariums connected by adjacent walls using a plurality of housing fasteners.

The second horizontal arrangement has two single door multi-niche dual locking modular columbariums connected by adjacent walls using a plurality of housing fasteners.

The second horizontal arrangement engages the first horizontal arrangement as follows: the bottom of the second horizontal arrangement is fastened to the top of the first horizontal arrangement with a plurality of housing fasteners.

Twelve (12) housing fasteners 112*a*-112*l* are used to engage the single door multi-niche dual locking modular columbariums of FIG. 7B.

In this example, the top left single door multi-niche dual locking modular columbariums is in a 3×4 arrangement. The top right single door multi-niche dual locking modular columbariums is in a 2×4 arrangement. The bottom right single door multi-niche dual locking modular columbariums is in a 6×4 arrangement. The bottom left single door multi-niche dual locking modular columbariums is in a 4×4 arrangement.

FIG. 7C depicts a horizontal arrangement. In this example, the single door multi-niche dual locking modular columbariums furthest to the left (module 1) is in a 6×4 arrangement. The adjacent single door multi-niche dual locking modular columbarium (module 2) is in a 4×4 arrangement. Adjacent to module 2 is a single door multi-niche dual locking modular columbarium (module 3) in a 3×4 arrangement. The single door multi-niche dual locking modular columbarium furthest to the right is in a 2×4 arrangement.

In this embodiment, the plurality of connected modular columbarium is fastened together horizontally, with a plurality of housing fasteners. Each single door multi-niche dual locking modular columbariums can contain identical single depth niches or identical double depth niches but different quantities of niches.

In embodiments, the modules can be in at least one of: a vertical alignment, a horizontal alignment, or an offset alignment.

In embodiments, a top can be placed on the final installed unit.

In embodiments, the top can be made of sheet steel. The sheet steel top can have a decorative covering.

The decorative covering can be tile made from stone, such as ceramic, marble, slate, quartz, granite, or any other stone.

The single door multi-niche dual locking modular columbarium assembly can be configured and aligned to receive simultaneously, multiple cremation containers into the dual niches via each unitary door without the need of special tools.

In embodiments, the single door multi-niche dual locking modular columbarium assembly can form a small footprint modular columbarium.

In embodiments, a single door multi-niche dual locking modular columbarium assembly can weigh from 150 pounds to 200 pounds.

Mrs. Jones brings in cremated remains of Mr. Jones to be interred. Mr. Smith brings in cremated remains of his mother Mrs. Smith, and Mrs. Brown brings in cremated remains of her Aunt Sally.

A unitary door is opened on a four-sided columbarium. The unitary door opens to 30 double niches.

In each double niche, two containers of cremated remains can be contained, each container being 4 inches long by 3 inches wide by 15 inches high.

The three cremation containers can be installed simultaneously into three different double niches.

The unitary door is then closed, and the dual non-identical key locking mechanism is locked securely.

While these embodiments have been described with emphasis on the embodiments, it should be understood that within the scope of the appended claims, the embodiments might be practiced other than as specifically described herein.

What is claimed is:

1. A single door multi-niche dual locking modular columbarium assembly for containing cremated remains configured to prevent unauthorized comingling or unauthorized disposition of the cremated remains, comprising:

a. a first single door multi-niche dual locking modular columbarium, the first single door multi-niche dual locking modular columbarium comprising:

(i) a first modular columbarium housing containing a plurality of niches each niche being a single depth niche or a double depth niche;

(ii) a first modular columbarium unitary door connected to the first modular columbarium housing covering all niches in the first single door multi-niche dual locking modular columbarium;

(iii) a first dual non-identical key locking mechanism forming a secure locking connection between the first modular columbarium unitary door and the first modular column barium housing, the first dual non-identical key locking mechanism requiring a first key profile different from a second key profile to unlock the first dual non-identical key locking mechanism;

b. a second single door multi-niche dual locking modular columbarium, the second single door multi-niche dual locking modular columbarium comprising:

(i) a second modular columbarium housing containing a plurality of niches, each niche being a single depth niche or a double depth niche;

(ii) a second modular columbarium unitary door connected to the second modular columbarium housing covering all niches in the second single door multi-niche dual locking modular columbarium;

(iii) a second dual non-identical key locking mechanism forming a secure locking connection between the second modular columbarium unitary door and the second modular columbarium housing, the second dual non-identical key locking mechanism requiring a third key profile different from a fourth key profile to unlock the second dual non-identical key locking mechanism;

c. a plurality of housing fasteners, each housing fastener for separating and connecting one of the single door multi-niche dual locking modular columbariums to an adjacent single door multi-niche dual locking modular columbarium in at least one of: a vertical alignment, a horizontal alignment, or an offset alignment; and wherein the single door multi-niche dual locking modular dual columbarium assembly for containing the cremated remains is configured to prevent unauthorized comingling or unauthorized disposition of the cremated remains in a user specified configuration using the plurality of dual locking modular columbarium, each single door multi-niche dual locking modular columbarium configured to receive multiple cremation containers into the niches via each modular columbarium unitary door.

2. The single door multi-niche dual locking modular columbarium assembly of claim 1, wherein each modular columbarium unitary door comprising:

(a) a single integral door frame covering all the niches; and (b) a unitary door insert installed in the single integral door frame; and (c) a hinge engaging the single integral door frame on a first side with the respective modular columbarium housing.

3. The single door multi-niche dual locking modular columbarium assembly of claim 2, wherein the single integral door frame is comprised of steel.

4. The single door multi-niche dual locking modular columbarium assembly of claim 1, wherein each modular columbarium housing comprises:

(i) a plurality of solid vertical walls;

(ii) a plurality of aligned horizontal bases connected between pairs of solid vertical walls defining a plurality of identical depth niches;

(iii) a top plate connected over the plurality of solid vertical walls;

(iv) a bottom plate connected over the plurality of vertical walls at an end opposite a top plate;

(v) a first side connected over an first end of the aligned horizontal bases; and (vi) a second side connected over a second end of the aligned horizontal bases opposite the first end of the aligned horizontal bases.

5. The single door multi-niche dual locking modular columbarium assembly of claim 4, wherein each of the solid vertical walls and aligned horizontal bases is comprised of steel.

6. The single door multi-niche dual locking modular columbarium assembly of claim 2, wherein the solid vertical walls extend at a right angle to the aligned horizontal bases.

7. The single door multi-niche dual locking modular columbarium assembly of claim 1 comprising a plurality of single door multi-niche dual locking modular columbarium with a first group fastened together horizontally and a second group fastened together vertically over the single door multi-niche dual locking modular columbarium fastened together horizontally wherein the single door multi-niche dual locking modular columbarium contain identical single depth niches or identical double depth niches but different quantities of niches.

8. The single door multi-niche dual locking modular columbarium assembly of claim 1 comprising a plurality of connected single door multi-niche dual locking modular columbarium fastened together horizontally, wherein each single door multi-niche dual locking modular columbarium contains identical single depth niches or identical double depth niches but different quantities of niches.

9. The single door multi-niche dual locking modular columbarium assembly of claim 1 wherein a first group of single door multi-niche dual locking modular columbarium having the same depth niches with different quantities of niches in each single door multi-niche dual locking modular columbarium of the first group, connects back to back with a second group of single door multi-niche dual locking modular columbarium having same depth niches, but different depth niches from the first group of single door multi-niche dual locking modular columbarium and with different quantities of niches in each single door multi-niche dual locking modular columbarium of the second group.

10. The single door multi-niche dual locking modular columbarium assembly of claim 1, wherein each single door multi-niche dual locking modular columbarium having double depth niches weighs from 150 pounds to 200 pounds.

11. The single door multi-niche dual locking modular columbarium assembly of claim 1, wherein each single door multi-niche dual locking modular columbarium having single depth niches weighs from 75 pounds to 100 pounds.

12. The single door multi-niche dual locking modular columbarium assembly of claim 1, wherein a quantity of niches in one of the single door multi-niche dual locking modular columbarium is different from a quantity of niches in an adjacent single door multi-niche dual locking modular columbarium.

13. A single door multi-niche dual locking modular columbarium for containing cremated remains configured to prevent unauthorized comingling or unauthorized disposition of the cremated remains, comprising:

(i) a modular columbarium housing containing a plurality of niches;

(ii) a modular columbarium unitary door connected to the modular columbarium housing covering all niches in the multi-niche dual locking modular columbarium;

(iii) a dual non-identical key locking mechanism forming a secure locking connection between the modular columbarium unitary door and the modular columbarium housing, first dual non-identical key locking mechanism requiring a first key profile different from a second key profile to unlock the dual non-identical key locking mechanism; and wherein the single door multi-niche dual locking modular columbarium for containing the cremated remains is configured to prevent unauthorized comingling or unauthorized disposition of the cremated remains in a user specified configuration of niches, the single door multi-niche dual locking modular columbarium configured to receive multiple cremation containers into the niches via the modular columbarium unitary door.

14. The single door multi-niche dual locking modular columbarium of claim 13, wherein the modular columbarium unitary door comprises:

(a) a single integral door frame covering all the niches wherein the niches are single depth niche spaces or double depth niche spaces; and (b) a unitary door insert installed in the single integral door frame; and (c) a hinge engaging the single integral door frame on a first side with the modular columbarium housing.

15. The single door multi-niche dual locking modular columbarium of claim 13 wherein the modular columbarium housing comprises:

(i) a plurality of solid vertical walls;

(ii) a plurality of aligned horizontal bases connected between pairs of solid vertical walls defining a plurality of identical sized niches;

(iii) a top plate connected over the plurality of solid vertical walls;

(iv) a bottom plate connected over the plurality of vertical walls at an end opposite a top plate;

(v) a first side connected over an first end of the aligned horizontal bases; and (vi) a second side connected over a second end of the aligned horizontal bases opposite the first end of the aligned horizontal bases.

* * * * *